US011577419B2

(12) United States Patent
Kamata

(10) Patent No.: US 11,577,419 B2
(45) Date of Patent: Feb. 14, 2023

(54) SHEET PERFORATING APPARATUS

(71) Applicant: TOSHIBA TEC KABUSHIKI KAISHA, Tokyo (JP)

(72) Inventor: Kimie Kamata, Sunto Shizuoka (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 110 days.

(21) Appl. No.: 17/142,593

(22) Filed: Jan. 6, 2021

(65) Prior Publication Data

US 2021/0122075 A1 Apr. 29, 2021

Related U.S. Application Data

(63) Continuation of application No. 16/353,488, filed on Mar. 14, 2019, now abandoned.

(51) Int. Cl.

| | |
|---|---|
| ***B26D 7/06*** | (2006.01) |
| ***B26D 7/18*** | (2006.01) |
| ***B26D 5/20*** | (2006.01) |
| ***B26D 5/00*** | (2006.01) |

(52) U.S. Cl.

CPC ..... *B26D 5/007* (2013.01); *B26D 5/20* (2013.01); *B26D 7/0683* (2013.01); *B26D 7/1845* (2013.01)

(58) Field of Classification Search

CPC ..... B26D 5/007; B26D 7/0683; B26D 5/20; B26D 7/1863; B26D 2007/0018; B16D 7/1845; G03G 15/6582; G03G 2215/00818; G03G 2215/008; G03G 2221/169; G03G 21/1633; G03G 21/1638; G03G 2402/45; B26F 1/02; Y10T 83/222; Y10T 83/2074; Y10T 83/943; Y10T 83/207

USPC ..... 83/167, 100, 291, 687; 15/347

See application file for complete search history.

(56) References Cited

U.S. PATENT DOCUMENTS

| | | | | |
|---|---|---|---|---|
| 6,728,992 | B1 * | 5/2004 | Rogers | E05F 5/08 16/86 A |
| 8,011,282 | B2 | 9/2011 | Yoshimaru | |
| 8,910,550 | B2 | 12/2014 | Furuta | |
| 9,606,493 | B2 | 3/2017 | Irie et al. | |
| 2007/0295178 | A1 | 12/2007 | Tsuji et al. | |
| 2010/0143015 | A1 | 6/2010 | Kubota et al. | |
| 2019/0004469 | A1 | 1/2019 | Dobashi | |

* cited by examiner

*Primary Examiner* — Ghassem Alie
(74) *Attorney, Agent, or Firm* — Kim & Stewart LLP

(57) ABSTRACT

A sheet perforating apparatus includes a punch unit configured to punch holes in a sheet from an image processing apparatus. A dust box is below the punch unit and detachably attached to a case. A lid member is attached to the dust box and is displaceable between a closed state, in which the lid member closes an opening of the dust box, and an open state, in which the lid member does not close the opening of the dust box. When in the open state, the lid member is electrically grounded to weaken static electricity of punch chips dropped from the punch unit to the lid member and directs the punch chips towards the opening.

20 Claims, 12 Drawing Sheets

SHEET PERFORATING APPARATUS

CROSS-REFERENCE TO RELATED APPLICATION

This application is a continuation of U.S. patent application Ser. No. 16/353,488, filed on Mar. 14, 2019, the entire contents of which are incorporated herein by reference.

FIELD

Embodiments described herein relate generally to a sheet perforating apparatus.

BACKGROUND

A sheet perforating apparatus is used to punch holes in a sheet processed by an image processing apparatus or the like. Punch chips generated by the punching of holes are collected in a dust box or the like. If the punch chips are charged with static electricity, the collected volume of the punch chips increases because punch chips may repel one another. Therefore, the amount of punch chips that can be collected in the dust box is lower than compared with the amount that can be collected if the punch chips are not charged with static electricity.

DETAILED DESCRIPTION

A sheet perforating apparatus comprises a punch unit configured to punch holes in a sheet from an image processing apparatus. A dust box is below the punch unit and detachably attached to a case. A lid member is attached to the dust box. The lid member is displaceable between a closed state, in which the lid member closes an opening of the dust box, and an open state, in which the lid member does not close the opening of the dust box. When in the open state, the lid member is electrically grounded to weaken static electricity of punch chips dropped from the punch unit to the lid member and directs the punch chips towards the opening.

A sheet perforating apparatus according to example embodiments is explained below with reference to the drawings.

In this application, an X direction, a Y direction, and a Z direction are defined as explained below. The Z direction is the height direction of the sheet perforating apparatus. The +Z direction is the upward direction. The Y direction is the depth direction of the sheet perforating apparatus. The movement direction of the dust box during an insertion from a removed state to a housed/installed state is the +Y direction (also referred to as the first direction in some contexts). The movement direction of the dust box from its housed/installed state to a removed state is the −Y direction (also referred to as the second direction in some contexts). The X direction is the width direction of the sheet perforating apparatus. The X direction, the Y direction, and the Z direction are orthogonal to one another.

First Embodiment

Figure 1:
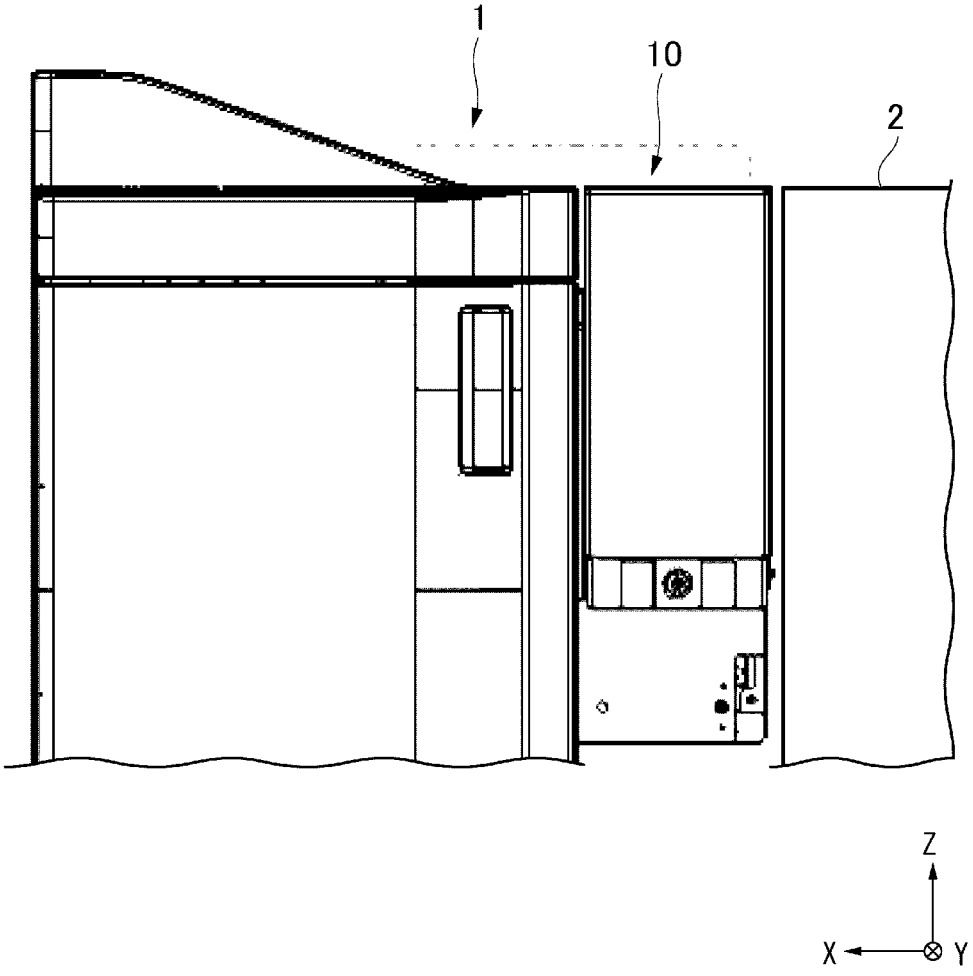
FIG. 1 is a front view of a sheet perforating apparatus in a first embodiment.

FIG. 1 is a front view of the sheet perforating apparatus according to the first embodiment.

A sheet perforating apparatus 10 is disposed between an image processing apparatus 2 and a post-processing apparatus 1 in the X direction. The image processing apparatus 2 performs processing such as image formation and image decoloring on a sheet. The sheet perforating apparatus 10 forms punch holes in the sheet. The post-processing apparatus 1 performs post-processing such as sorting and stapling on the sheet. The sheet is conveyed from the image processing apparatus 2 to the post-processing apparatus 1 through the sheet perforating apparatus 10.

Figure 2:
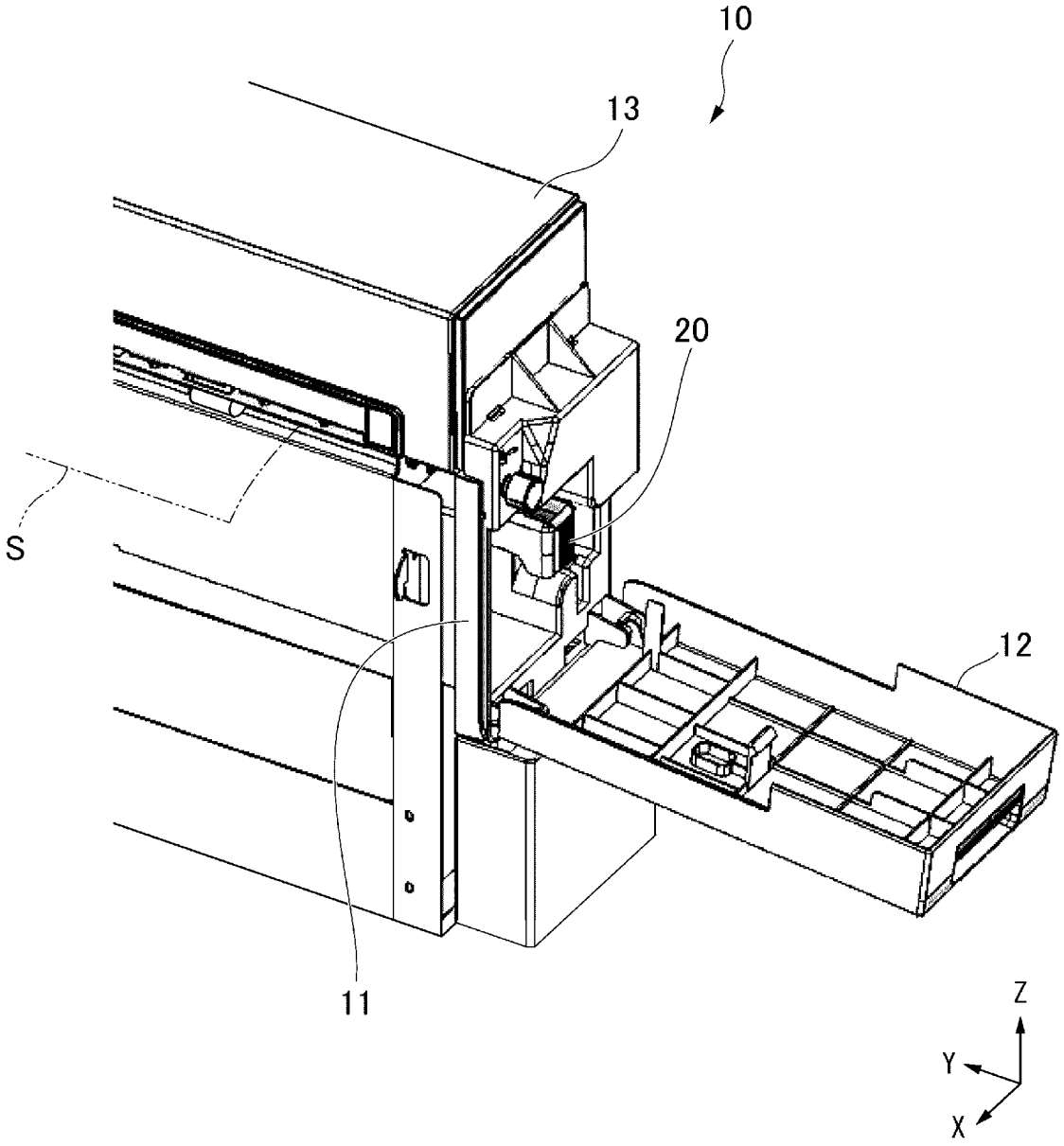
FIG. 2 is a perspective view of the sheet perforating apparatus.

FIG. 2 is a perspective view of the sheet perforating apparatus according to the first embodiment.

The sheet perforating apparatus 10 includes a punch unit cover 13, a dust box 20, a main body cover 11, and a front cover 12.

The punch unit cover 13 covers the outside of a punch unit. The punch unit punches holes in the sheet S.

The dust box 20 collects punch chips caused by the formation of the punch holes.

The main body cover 11 covers the periphery of a case that houses the dust box 20.

The front cover 12 is disposed in the −Y direction from the dust box 20. The end portion (in the −Z direction) of the front cover 12 is hinge-coupled to the main body cover 11. The front cover 12 is capable of opening and closing with respect to the main body cover 11. When the front cover 12 is open, the dust box 20 can be pushed into or pulled out from the sheet perforating apparatus 10. The sheet perforating apparatus 10 includes a front cover sensor (not specifically illustrated in FIG. 2) that detects the open state of the front cover 12. If the front cover sensor detects the open state, hole punching by the punch unit is prohibited.

Figure 3:
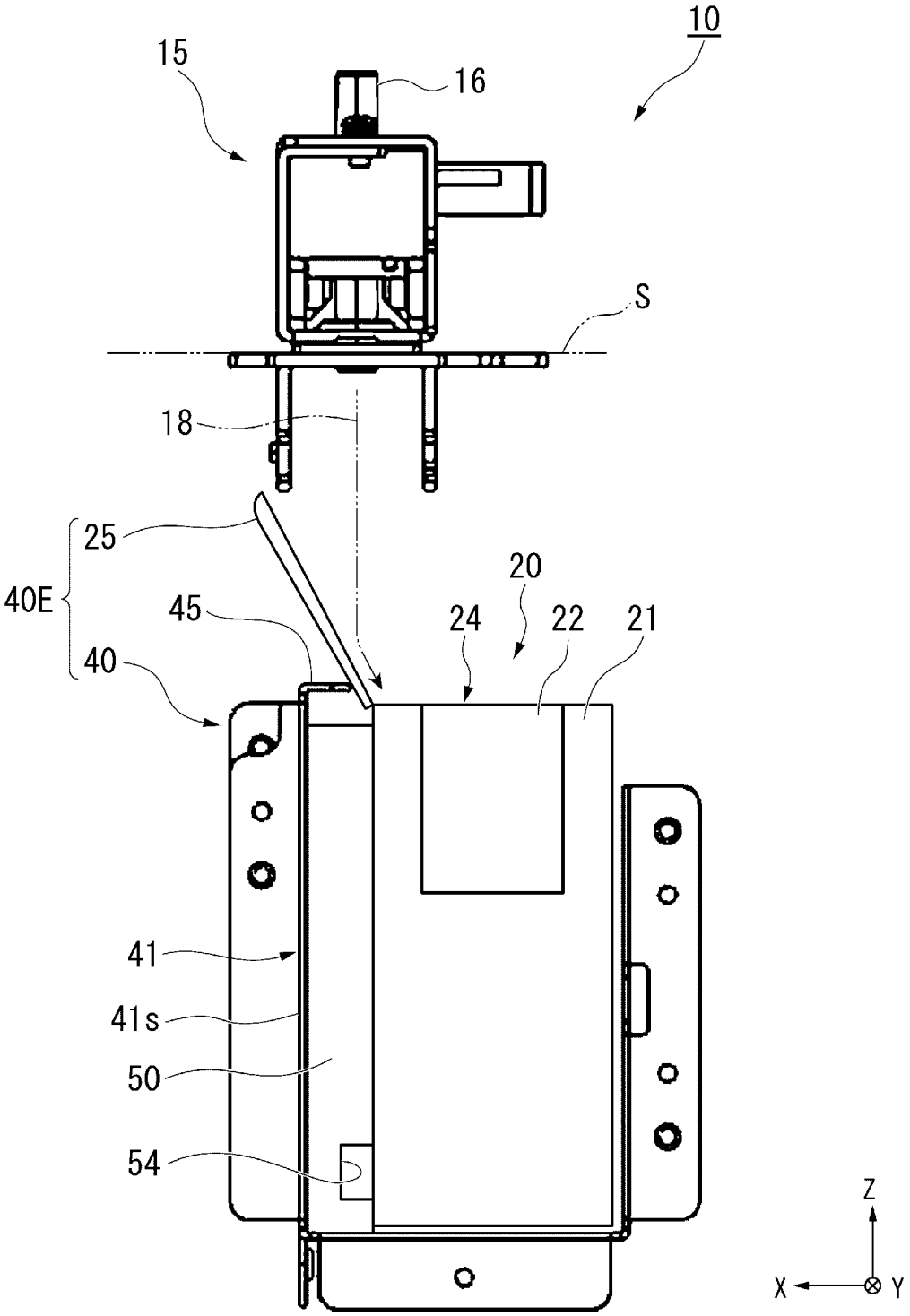
FIG. 3 is a front view of a punch unit, a dust box, and a case main body.

FIG. 3 is a front view of the punch unit 15, the dust box 20, and the case main body 41. The sheet perforating apparatus 10 includes the punch unit 15, the dust box 20, and a case 40 including a case main body 41.

The punch unit 15 is disposed in upper portion of the sheet perforating apparatus 10. The punch unit 15 includes a punch 16 that forms a punch hole in the sheet S. A punch chip caused by the formation of the punch hole drops in the −Z direction from the punch unit 15.

The dust box 20 is disposed below the punch unit 15.

Figure 4:
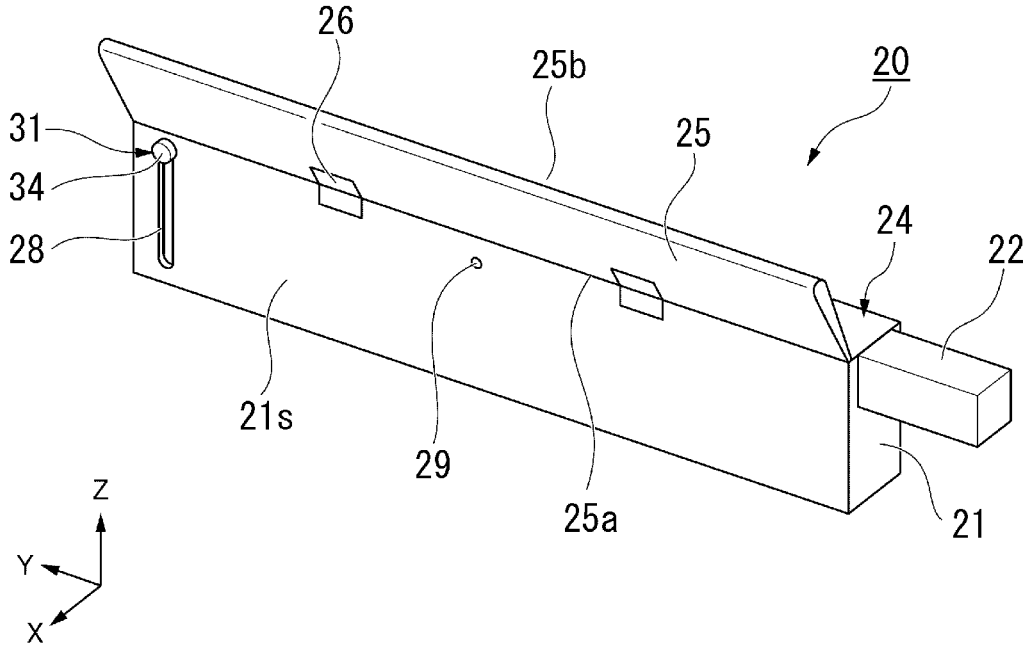
FIG. 4 is a perspective view of a dust box.

FIG. 4 is a perspective view of the dust box 20. The dust box 20 includes a box main body 21, a handle 22, a lid member 25, and an opening and closing device 31.

The box main body 21 is formed of a resin material, a metal material, or the like. The box main body 21 is formed in a rectangular parallelepiped shape extending longitudinally in the Y direction. The box main body 21 includes an opening 24 on an upper surface side. The opening 24 is formed in a rectangular shape extending in the Y direction.

The box main body 21 includes a fullness detection hole 29. The fullness detection hole 29 is formed in a sidewall 21*s* of the box main body 21. The fullness detection hole 29 is formed near an upper portion (in the +Z direction) of the sidewall 21*s*.

The handle 22 extends in the −Y direction from a sidewall of the box main body 21. The handle 22 can be gripped by a user of the sheet perforating apparatus 10. The user grips the handle 22 to push the dust box 20 into and pull the dust box 20 out from the case.

The lid member 25 is formed of a conductive material. For example, the lid member 25 is formed of a metal material, a conductive polymeric material, or the like. The lid member 25 is formed in a rectangular shape extending in the Y direction. The external shape of the lid member 25 corresponds to the external shape of the opening 24. An edge portion (in the −Z direction and the +X direction) of the lid member 25 is a first edge portion 25*a*. Another edge portion (in the +Z direction and the −X direction) of the lid member 25 is a second edge portion 25*b*. The lid member 25 is formed to be thicker at the second edge portion 25*b* than at the first edge portion 25*a*. The first edge portion 25*a* is connected to an upper end portion (in the +Z direction) of the sidewall 21*s* by hinges 26. The second edge portion 25*b* is capable of rotating around the Y axis. The lid member 25 is displaceable between a closed state in which the lid member 25 closes/covers the opening 24 and an open state in which the lid member 25 leaves open/uncovered the opening 24.

Figure 5:
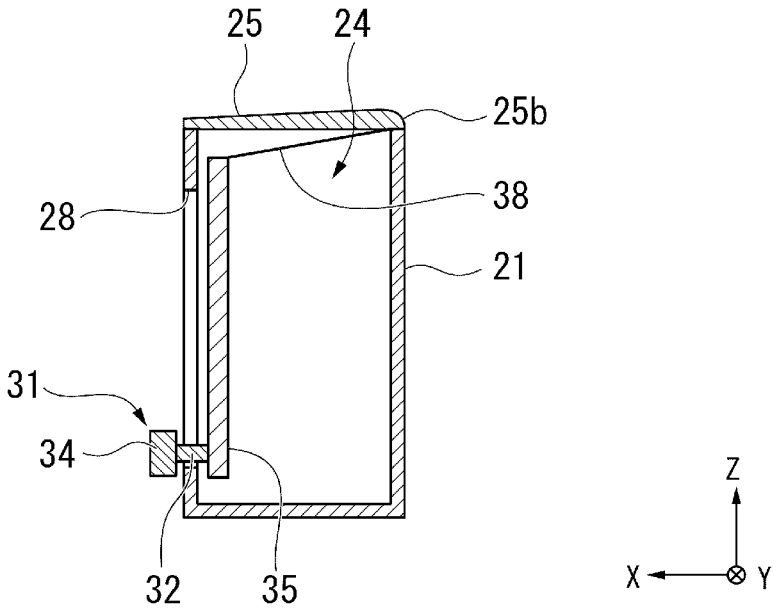
FIG. 5 depicts aspects of an operation of an opening and closing device.
Figure 6:
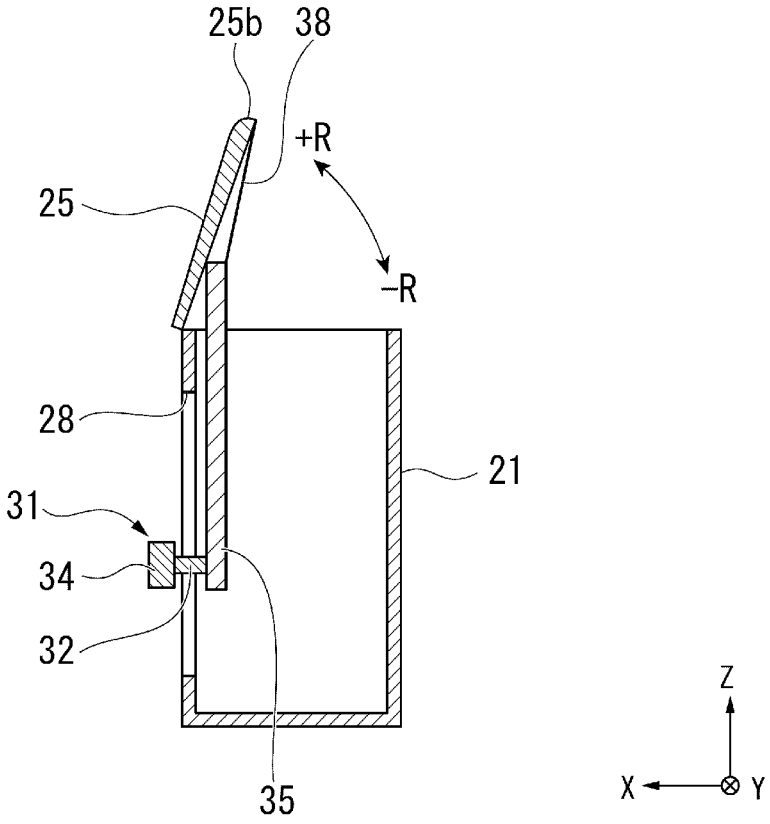
FIG. 6 depicts additional aspects of the operation of the opening and closing device.
Figure 7:
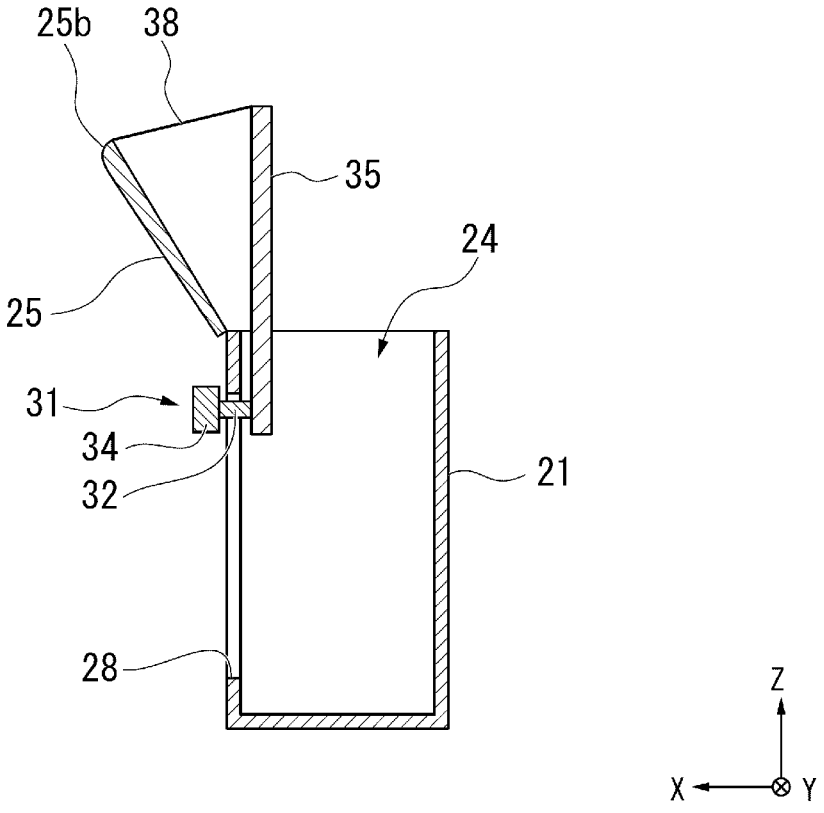
FIG. 7 depicts further aspects of the operation of the opening and closing device.

FIGS. 5, 6, and 7 are front sectional views of the dust box 20 at different open and closed positions of the lid member 25 according to changes in the position of the opening and closing device 31. A closed state of the lid member 25 is illustrated in FIG. 5. An open state of the lid member 25 is illustrated in FIG. 7.

As illustrated in FIGS. 5, 6 and 7, movement of the opening and closing device 31 opens and closes the lid member 25. The opening and closing device 31 includes a slot or long hole 28, an operation section 34, a push-up section 35, a coupling section 32, and a string section 38.

The long hole 28 pierces the sidewall 21*s*. The long hole 28 is formed at one end portion (in the +Y direction) of the sidewall 21*s*. The long hole 28 extends in the Z direction from a first end portion (in the −Z direction) to a second end portion (in the +Z direction).

The operation section 34 has a button shape or the like. The operation section 34 is on the +x side of the long hole 28 on the box main body 21. The width (in the Y direction) of the operation section 34 is larger than the width (in the Y direction) of the long hole 28.

The push-up section 35 is a bar or plate shaped member extending in the Z direction. The push-up section 35 is disposed on the −X side of the long hole 28 on the box main body 21. The width (in the Y direction) of the push-up section 35 is larger than the width (in the Y direction) of the long hole 28. A first end portion (in the −Z direction) of the push-up section 35 is opposite (in the −X direction) the operation section 34.

The coupling section 32 is disposed between the operation section 34 and the push-up section 35 and couples the operation section 34 and the push-up section 35. The coupling section 32 is disposed inside the long hole 28. Consequently, the operation section 34, the push-up section 35, and the coupling section 32 are movable in the Z direction along the long hole 28 as an integrated unit.

The string section 38 is a rubber string, rubber band or the like having elasticity. An end portion of the string section 38 is connected to an end portion (in the +Z direction) of the push-up section 35. Another end portion of the string section 38 is connected to the second edge portion 25*b*.

Displacement of the lid member 25 from the closed state to the open state is explained.

As illustrated in FIG. 5, in the closed state of the lid member 25, the operation section 34 is disposed at lower end of the long hole 28. At this time, the upper end portion (in the +Z direction) of the push-up section 35 is not in contact with the lid member 25.

As illustrated in FIG. 6, the operation section 34 moves in the +Z direction along the long hole 28. The upper end portion of the push-up section 35 pushes up the lid member 25. The second edge portion 25*b* of the lid member 25 moves/rotates in a +R direction.

As illustrated in FIG. 7, the operation section 34 moves in the +Z direction to an upper end portion of the long hole 28. The second edge portion 25*b* is thicker than the first edge portion 25*a*. The lid member 25 thus tilts towards the sidewall 21*s* under its own weight. The tilt of the lid member 25 is restricted by contact with a protruding section 45 of the case main body 41.

Displacement of the lid member 25 from the open state to the closed state is explained.

As illustrated in FIG. 6, the operation section 34 can move in the −Z direction along the long hole 28. The upper end portion of the push-up section 35 and the second edge portion 25*b* are coupled by the string section 38. When the push-up section 35 moves in the −Z direction, the second edge portion 25*b* turns/rotates in a −R direction due to the tension/pull of the string section 38. When the lid member 25 turns away from the sidewall 21*s*, the lid member 25 turns in the −R direction by the weight of the lid member 25.

As illustrated in FIG. 5, the operation section 34 also moves to the lower end portion of the long hole 28. The second edge portion 25*b* eventually comes into contact with the box main body 21 and the turning of the lid member 25 stops and the lid member 25 is in the closed state.

Figure 8:
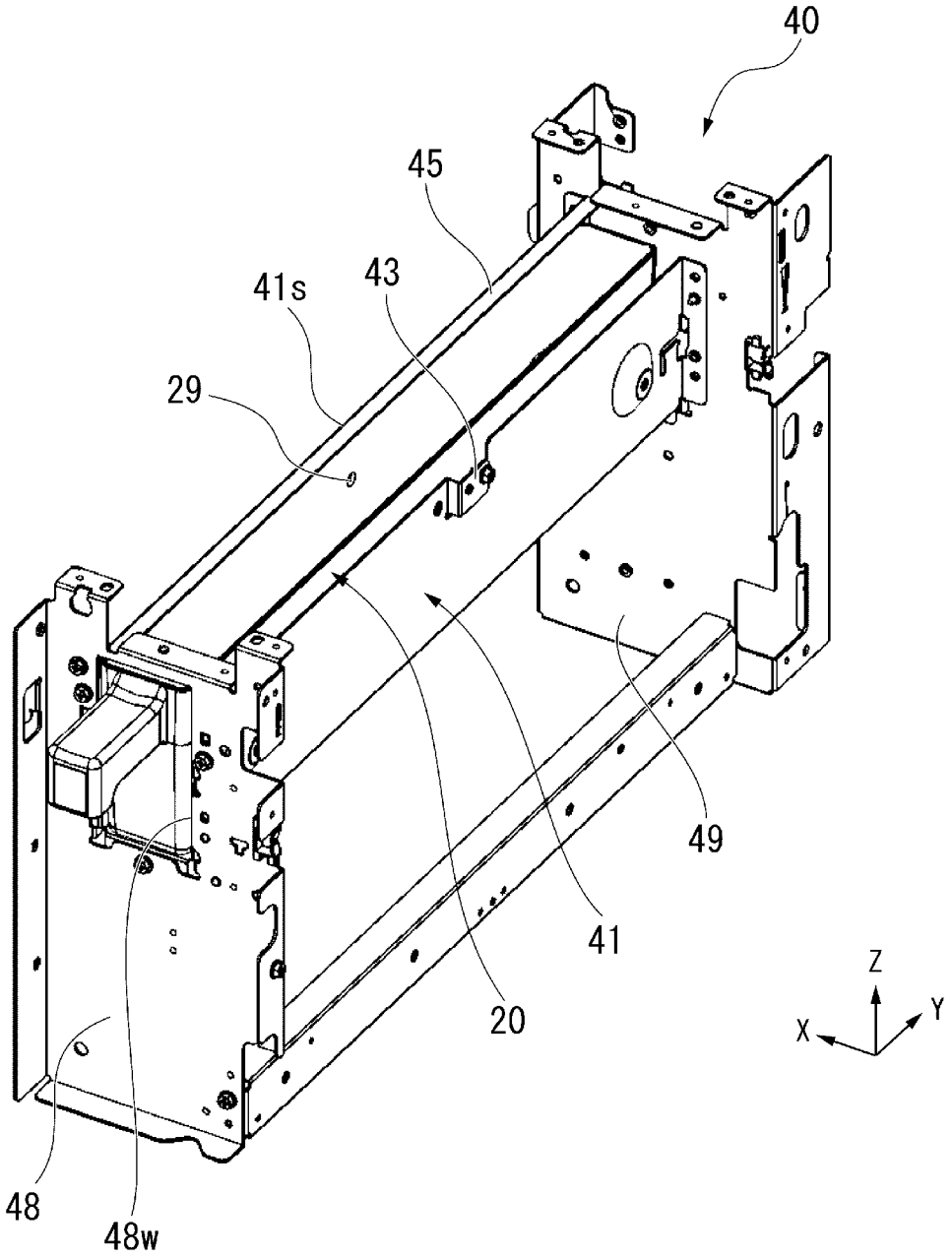
FIG. 8 is a perspective view of a case.

FIG. 8 is a perspective view of the case. In FIG. 8, the dust box 20 is depicted as housed within the case 40. In FIG. 8, specific illustration of the lid member 25 is omitted.

The case 40 includes the case main body 41, a front plate section 48, a rear plate section 49, and a grooved member 50 (see FIG. 3). The case main body 41, the front plate section 48, and the rear plate section 49 are formed of a metal material or the like having electrical conductivity.

The case main body 41 extends in the Y direction. A cross-sectional shape of the case main body 41 is a substantial U shape if the case main body 41 is cut along a direction perpendicular to the Y direction. The case main body 41 covers the +X side, the −X side, and the −Z side of the dust box 20. An end portion (in the −Y direction) of the case main body 41 is connected to the front plate section 48. Another end portion (in the +Y direction) of the case main body 41 is connected to the rear plate section 49.

The case main body 41 includes a fullness sensor 43. For example, the fullness sensor 43 is an optical sensor. The fullness sensor 43 detects light pass through a fullness detection hole 29 in the dust box 20. If the dust box 20 is filled by punch chips, the light through the fullness detection hole 29 will be blocked by the punch chips. Consequently, the fullness sensor 43 can detect that the dust box 20 is filled with the punch chips.

The front plate section 48 is disposed in the −Y direction of the case main body 41. The front plate section 48 includes an opening section 48*w* into the interior the case main body 41. The dust box 20 is pushed into and pulled out from the case main body 41 through the opening section 48*w*. The dust box 20 is detachably attachable to the case main body 41.

The rear plate section 49 is disposed in the +Y direction of the case main body 41. The rear plate section 49 covers the +Y end of the dust box 20. At least one of the front plate section 48 and the rear plate section 49 is electrically grounded via another component such as the post-processing apparatus 1.

As illustrated in FIG. 3, the case main body 41 includes the protruding section 45. The protruding section 45 is formed over substantially the entire length along the Y direction of the case main body 41. The protruding section 45 projects in the −X direction from an upper end portion (in the +Z direction) of a sidewall 41*s* (on the +X side) of the case main body 41.

The lid member 25 is in contact with the protruding section 45 when in the open state. The tilt of the lid member 25 is restricted by the contact with the protruding section 45. In the open state, the lid member 25 intersects the Z direction and the X direction. That is, the lid member 25 is inclined toward the opening 24 of the dust box 20. In the open state, the lid member 25 is disposed below (in the −Z direction) of the punch unit 15. The case main body 41 including the protruding section 45 is specifically formed and disposed to realize such disposition of the lid member 25.

The lid member 25 and the case 40 function as a static-electricity weakening unit 40E. The lid member 25 is formed of a metal material or the like having electrical conductivity. The lid member 25 is in electrical contact with the protruding section 45 of the case main body 41 when in the open state. The case main body 41, the front plate section 48, and the rear plate section 49 are also formed of the metal material or the like having electrical conductivity. At least one of the front plate section 48 and the rear plate section 49 is electrically grounded. Consequently, the lid member 25 is also electrically grounded when in the open state. The protruding section 45 is conductively connected to the case 40 to electrically ground the lid member 25 when in the open state.

The sheet perforating apparatus 10 forms punch holes in a sheet after image formation or the like. In the image formation processing (e.g., printing), the sheet may be charged with static electricity. Punch chips may thus likewise be charged with static electricity after formation. When the punch chips drop from the punch unit 15 as indicated by an arrow 18, the punch chips come into contact with the opened lid member 25. Since the lid member is grounded, the static electricity on the punch chips dissipates or disappears. The lid member 25 is inclined toward the opening 24 of the dust box 20. Therefore, the punch chips are guided toward the opening 24 and collected in the dust box 20. Since the static electricity on the punch chips is weakened, the punch chips will not repel one another as much fully charged punch chips. The punch chips with a lessen or removed static electrical charge thereon will better overlap and deposit on at bottom surface of the dust box 20. Therefore, more punch chips can be collected in the dust box 20. Since the static electricity of the punch chips is weakened, adhesion of the punch chips to the sidewall of the dust box 20 is also reduced. Consequently, clogging or inadvertent blocking of the fullness detection hole 29 by static electrically adhered punch chips is prevented or reduced. Therefore, erroneous detection of a full dust box 20 by the fullness sensor 43 is prevented or reduced in frequency.

The grooved member 50 illustrated in FIG. 3 is formed of a resin material or the like. The grooved member 50 is disposed between the sidewall 41*s* (on the +X side of the case body 41) and the dust box 20. The size of the grooved member 50 along in the Y direction and the Z direction correspond to the sizes of the case main body 41 and the dust box 20 in those directions. A groove section 54 is formed on a side surface of the grooved member 50. The opening and closing unit 30 of the lid member 25 is formed by the groove section 54 provided in the case 40 and the opening and closing device 31 provided in the dust box 20.

Figure 9:
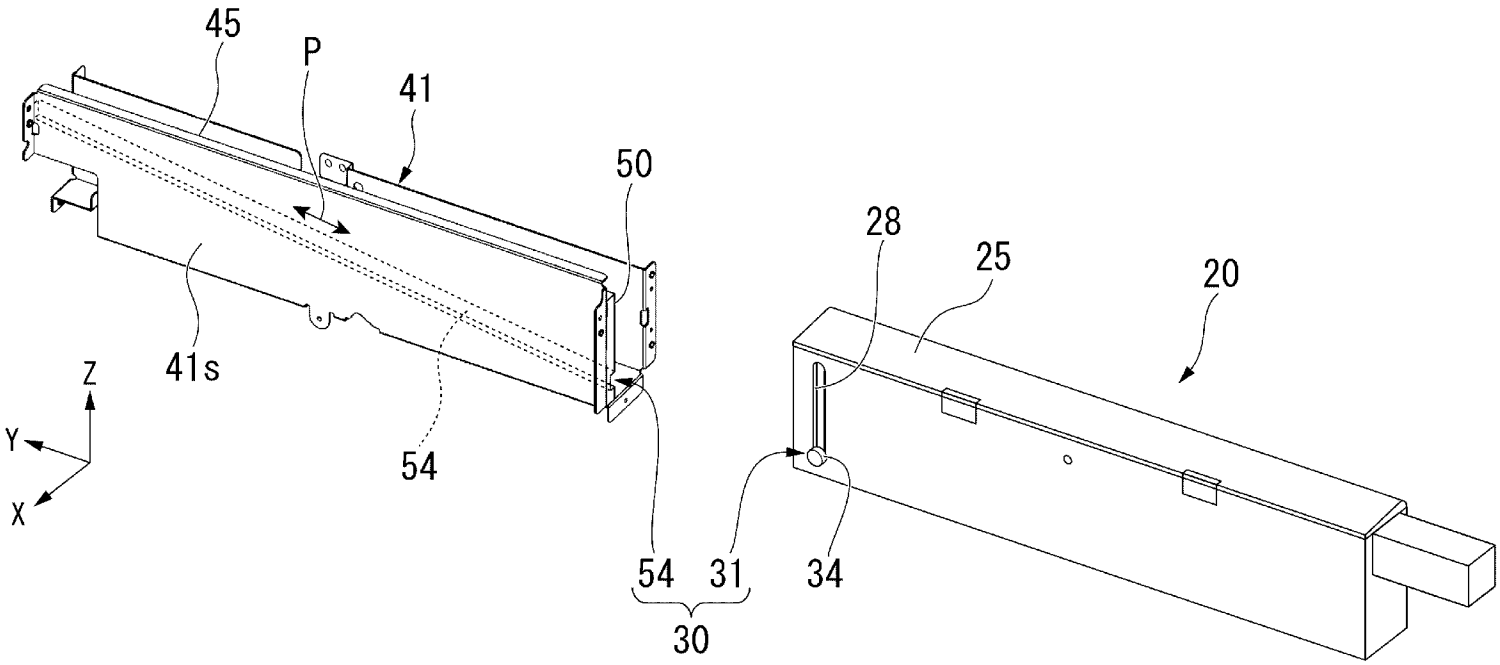
FIG. 9 depicts aspects of an operation of an opening and closing unit.

FIG. 9 is an explanatory diagram of the operation of the opening and closing unit 30 and is also a perspective view of the case main body 41 and the dust box 20 in a disengaged state. In FIG. 9, the dust box 20 has been taken out from the case main body 41.

The groove section 54 extends in a P direction intersecting the Y direction. The groove section 54 linearly extends from an end portion at the −Y end and the −Z side of the grooved member 50 to an end portion at the +Y end and the +Z side of the grooved member 50. The groove section 54 is thus inclined with respect to the Y direction and the Z direction. The width (in the Z direction) of the groove section 54 is larger than the width (in the Z direction) of the operation section 34 of the dust box 20. The depth (along the X direction) of the groove section 54 is larger than the height (along the X direction) of the operation section 34.

In the uninstalled state of the dust box 20, the lid member 25 is in a closed state. As illustrated in FIG. 5, the operation section 34 is disposed at the lower end portion (in the −Z direction) of the long hole 28. As the dust box 20 moves in the +Y direction when being inserted into the case main body 41, the operation section 34 engages the groove section 54. The operation section 34 thus moves in the +Z direction according to the movement in the +Y direction of the dust box 20 since the groove section 54 is inclined toward the +Z direction along its the +Y direction. Once the dust box 20 moves to the end portion (in the +Y direction) of the case main body 41, the dust box 20 is in its installed state. The operation section 34 has moved to the upper end portion (in the +Z direction) of the long hole 28. Consequently, as illustrated in FIG. 7, the lid member 25 changes to the open state.

In this way, the opening and closing unit 30 displaces the lid member 25 from a closed state to an open state according to whether the dust box 20 is in an installed or uninstalled state.

As the dust box 20 moves in the −Y direction from its installed state, the operation section 34 moves in the −Z direction since the groove section 54 is inclined toward the −Z direction along its −Y direction. Once the dust box 20 comes out of the case main body 41, the dust box 20 changes to its uninstalled state. In the uninstalled state, the operation section 34 is disposed at the lower end portion (in the −Z direction) of the long hole 28. Consequently, as illustrated in FIG. 5, the lid member 25 in its closed state.

In this way, the opening and closing unit 30 displaces the lid member 25 from an open state to a closed state when the dust box 20 is removed/uninstalled from the case main body 41.

Figure 10:
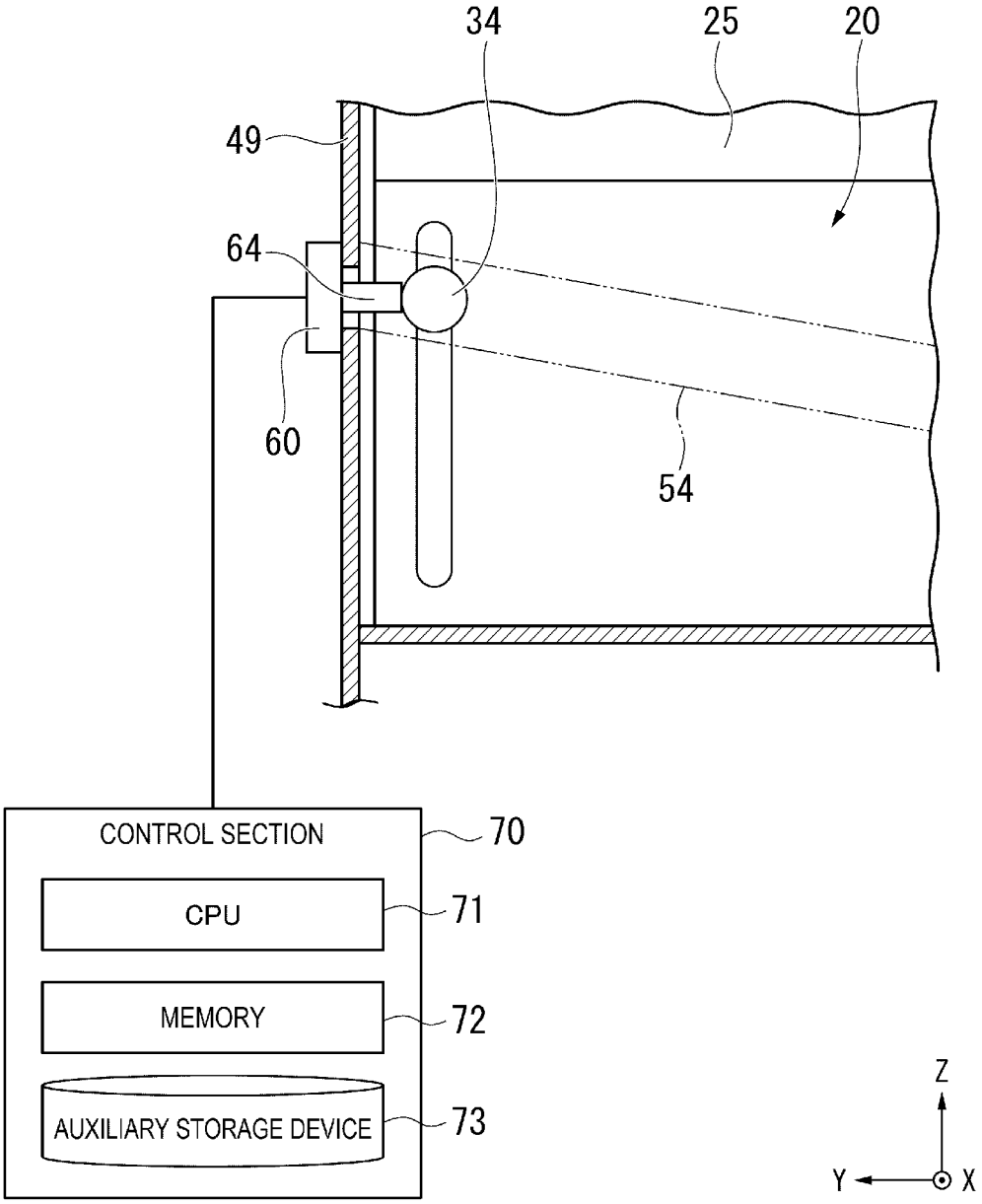
FIG. 10 is a schematic configuration diagram of a housing sensor and a control section.

FIG. 10 is an explanatory diagram of a housing sensor and a control section.

A housing sensor 60 detects when the dust box 20 is in its fully installed state. For example, the housing sensor 60 is a contact-type sensor. The housing sensor 60 is fixed to the surface of the rear plate section 49 of the case 40. A contactor 64 of the housing sensor 60 extends in the −Y direction through a sensor hole of the rear plate section 49 and is positioned to be inside the groove section 54. In the installed state of the dust box 20, the operation section 34 is disposed at the end portion (in the +Y direction) of the groove section 54. The operation section 34 thus comes into contact with the contactor 64, whereby the housing sensor 60 detects the dust box 20 as installed. The housing sensor 60 transmits a detection signal of the installation state to a control section 70.

The sheet perforating apparatus 10 includes a (central processing unit (CPU) 71, a memory 72, and an auxiliary storage device 73. The auxiliary storage device 73 is as a magnetic hard disk device or a semiconductor storage device. The auxiliary storage device 73 stores information. The CPU 71 executes computer programs stored in the memory 72 and the auxiliary storage device 73 to function as the control section 70. The control section 70 controls various operations of the sheet perforating apparatus 10.

If the control section 70 receives the detection signal from the housing sensor 60, the control section 70 permits the punching of holes by the punch unit 15. If the control section 70 does not receive the detection signal from the housing sensor 60, the control section 70 prohibits the punching of holes by the punch unit 15. That is, the housing sensor 60 functions as an interlock switch. Likewise, if the attachment/installation of the dust box 20 is incomplete, the operation of the punch unit 15 is prohibited. Therefore, punch chips are prevented from being scattered without being collected in the dust box 20.

As explained above, the sheet perforating apparatus 10 includes the punch unit 15, the dust box 20, the lid member 25, and the static electricity weakening unit 40E. The punch unit 15 forms punch holes in the sheet S processed by the image processing apparatus 2. The dust box 20 includes the opening 24 in its upper part. The lid member 25 is attached to the dust box 20. The lid member 25 is capable of being displaced between a closed state and an open state. The lid member 25 is disposed below the punch unit 15 in the open state. When opened, the lid member 25 functions as a guide for punch chips dropping from the punch unit 15 towards the opening 24. The static electricity weakening unit 40E lessens the static electrical charge on the punch chips dropped onto the lid member 25.

Since the lid member 25 is attached to the dust box 20, scattering of the collected punch chips is prevented. Since the punch chips dropping from the punch unit 15 are guided to the opening 24, the punch chips are efficiently collected. Since the lid member 25 guides the punch chips to the opening 24, it is unnecessary to provide a separate guiding member. An increase in apparatus cost is thus prevented. The punch chips with a reduced static electrical charge are collected more efficiently in the dust box 20 because the punch chips do not repel each other as much. The punch chips therefore pack and deposit on the bottom surface of the dust box 20 better than otherwise would be the case. Therefore, more punch chips can be collected in the dust box 20 before an emptying of the dust box 20 is required.

The lid member 25 is formed of an electrically conductive material. The static-electricity weakening unit 40E includes the protruding section 45 conductively connected to the case 40 by which the lid member 25 is grounded when in an open state.

The static-electricity weakening unit 40E reduces the static electrical charge on the punch chips using electrical conductance through the lid member 25 and the case 40. Therefore, an increase in apparatus cost is prevented.

The sheet perforating apparatus 10 includes the opening and closing unit 30. The opening and closing unit 30 functions to displace the lid member 25 from the closed state to the open state according to insertion of the dust box 20 into the case 40. The opening and closing unit 30 functions to displace the lid member 25 from the open state to the closed state according to removal of the dust box 20 from the case 40.

The opening and closing unit 30 includes the groove section 54 and the opening and closing device 31. The groove section 54 is formed in the case 40 and extends in a direction inclined with respect to Y axis direction. The opening and closing device 31 is provided on the dust box 20. The opening and closing device 31 includes the operation section 34 that moves on the inside of the groove section 54 during installation and removal of the dust box 20.

The opening and closing device 31 includes the push-up section 35 that moves in the +Z direction during installation of the dust box 20 and pushes up the lid member 25 towards an open state.

The opening and closing device 31 includes the string section 38 that pulls down the lid member 25 during removal of the dust box 20.

Consequently, the lid member 25 is automatically displaced between the closed state and the open state as necessary during removal or installation of the dust box 20 by purely mechanical means. Therefore, provision of electric mechanism to perform opening and closing of the lid member 25 is unnecessary. An increase in apparatus cost is thereby prevented.

The lid member 25 is formed to be thicker at the second edge portion 25*b* opposite to the first edge portion 25*a* that is attached to the dust box 20 Thereby, the shifting of the lid member 25 between the open state and the closed state is facilitated due to the lid member 25 own weight.

The sheet perforating apparatus 10 includes the housing sensor 60 and the control section 70. The housing sensor 60 detects the installed state of the dust box 20. If the housing sensor 60 does not detect a completely installed state for the dust box 20, the control section 70 prohibits the operation of the punch unit 15.

Figure 11:
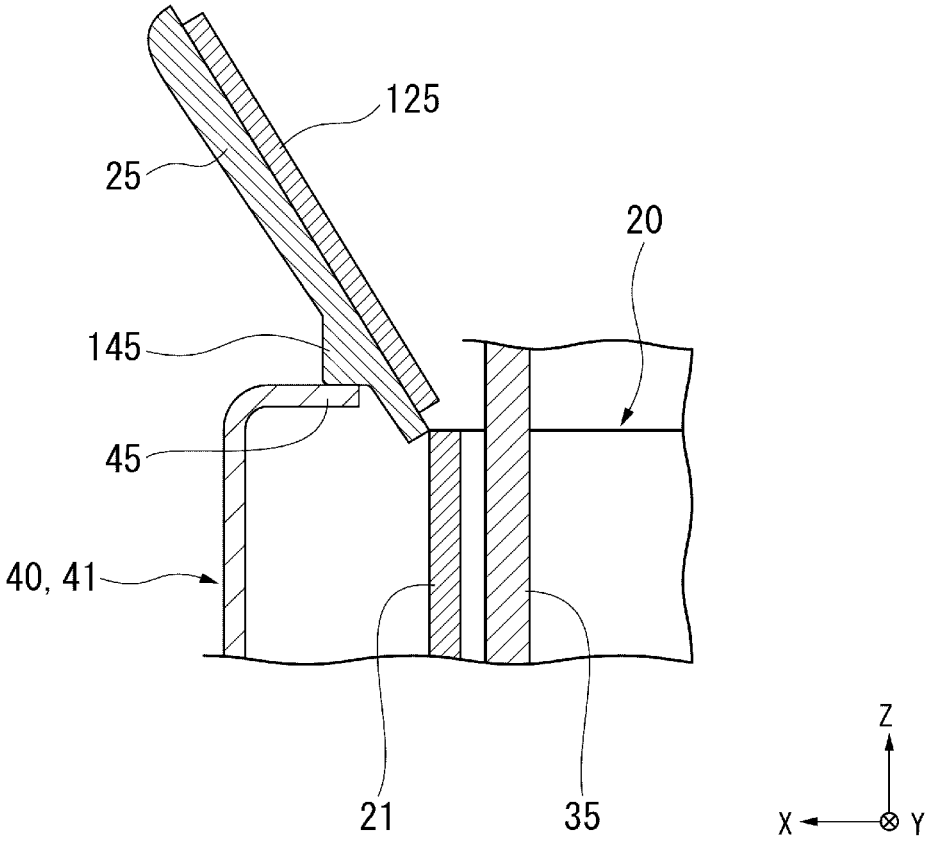
FIG. 11 depicts aspects of a dust box in a sheet perforating apparatus according to a modification of a first embodiment.

FIG. 11 is an explanatory diagram of a dust box in a sheet perforating apparatus according to a modification of the first embodiment. FIG. 11 is a partial a front sectional view of the dust box 20. In FIG. 11, the open state of the lid member 25 is illustrated. Explanation of those portions of this modification which are the same as that of the sheet perforating apparatus according to the first embodiment is omitted.

The dust box 20 in this modification includes a static-electricity weakening sheet 125. The static-electricity weakening sheet 125 is formed by incorporating an electrically conductive substance within a base material such as woven fabric. By adjusting the content of the electrically conductive substance, the electrical resistance (conductivity) of the static-electricity weakening sheet 125 can be adjusted. The static-electricity weakening sheet 125 is attached to a surface of the lid member 25 in exposed when in its open state. The area of the static-electricity weakening sheet 125 corresponds to the area of the lid member 25.

The static-electricity weakening sheet 125 functions as a part of the static-electricity weakening unit 40E (see FIG. 3). If the punch chips charged with static electricity drop on to the static-electricity weakening sheet 125, an electric current flows from the punch chips to the lid member 25 through the static-electricity weakening sheet 125. Consequently, the static electricity on the punch chips lessens or disappears. The punch chips slide down the surface of the static-electricity weakening sheet 125 and are collected in the dust box 20.

The dust box 20 in the modification includes a projecting section 145 in the lid member 25. The projecting section 145 is formed integrally with the lid member 25. The projecting section 145 is formed on a surface below (in the −Z direction) the lid member 25 in the open state. The projecting section 145 is formed over an entire length (along the Y direction) of the lid member 25.

The projecting section 145 functions as a part of the static-electricity weakening unit 40E. The projecting section 145 is a connecting section electrically connected to the case 40 to which the lid member 25 in the open state is grounded. In the open state of the lid member 25, the projecting section 145 is in contact with the protruding section 45 of the case main body 41. A lower surface (in the −Z direction) the projecting section 145 is in physical contact with an upper surface of the protruding section 45. Consequently, a contact area of the lid member 25 and the protruding section 45 increases and the electric resistance between the lid member 25 and the protruding section 45 decreases. Therefore, an electric current more easily flows from the punch chips to the protruding section 45 through the lid member 25. The weakening of the static electricity on the punch chips is thus facilitated.

Second Embodiment

An opening and closing device according to a second embodiment includes a cam section instead of a push-up section 35 in the first embodiment. Explanation of aspects of a sheet perforating apparatus according to the second embodiment which are substantially the same as the first embodiment may be repeated in the description of the second embodiment.

Figure 12:
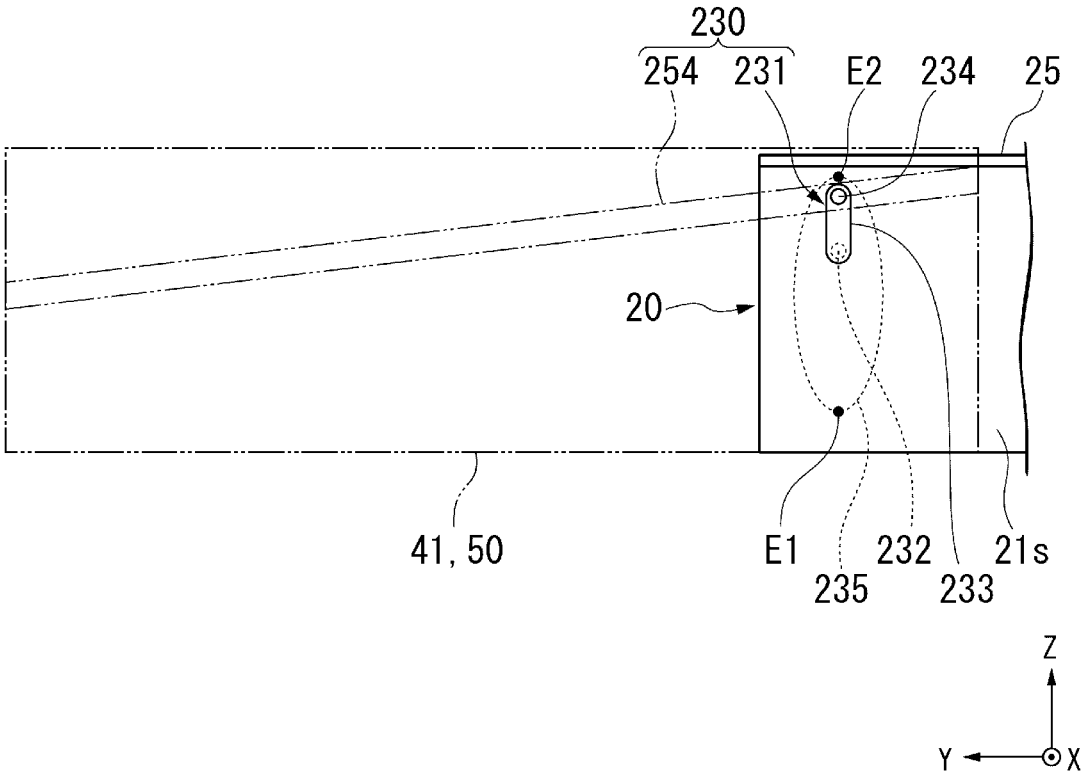
FIG. 12 depicts aspects of an operation of an opening and closing unit in a sheet perforating apparatus in a second embodiment.
Figure 13:
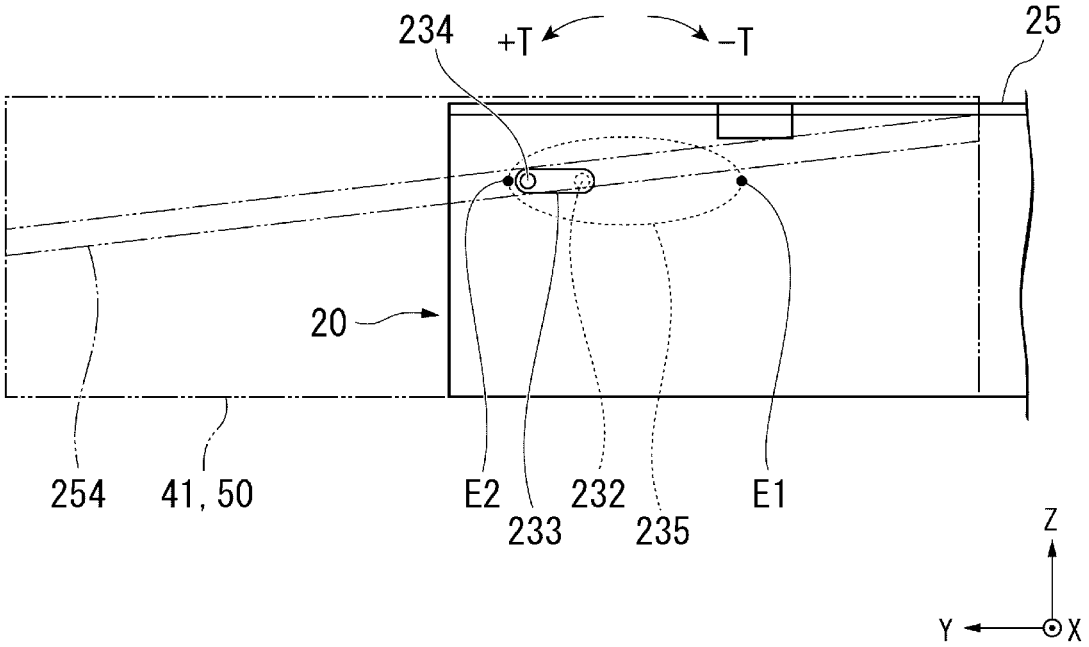
FIG. 13 depicts additional aspects of the operation of the opening and closing unit.
Figure 14:
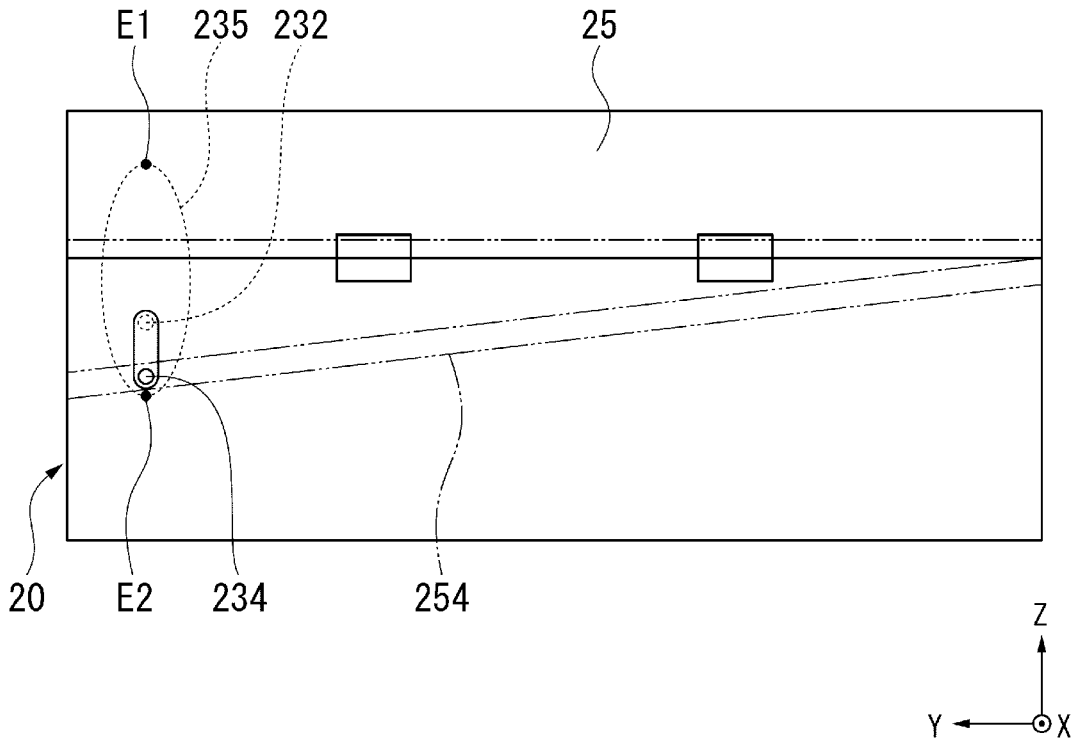
FIG. 14 depicts further aspects of the operation of the opening and closing unit.

FIGS. 12-14 are a first explanatory diagrams of the operation of an opening and closing unit in the sheet perforating apparatus in the second embodiment.

As illustrated in FIG. 12, an opening and closing device 231 includes a cam section 235, a turning shaft 232, a coupling section 233, an operation section 234, and a string section (though not specifically illustrated in FIG. 12, see e.g., FIGS. 6 and 7).

The cam section 235 has an elliptical plate shape. The cam section 235 is disposed adjacent an inside surface of the sidewall 21*s* to be parallel to the sidewall 21*s* of the dust box 20. A first end portion E1 of the cam section 235 along the major axis direction of the cam section 235 is coupled to the lid member 25 by the string section.

The turning shaft 232 is fixed to the cam section 235. The turning shaft 232 is centered on the cam section 235 in the minor axis direction and is closer to a second end portion E2 (along the major axis direction) of the cam section 235. The turning shaft 232 is inserted into a through-hole in the sidewall 21*s* to permit rotation/pivoting around the turning shaft 232. The through-hole in the sidewall 21*s* is higher (toward the +Z direction side) than a center point of the sidewall 21*s* along the Z direction. The turning shaft 232 extends in the +X direction into the sidewall 21*s*.

The coupling section 233 is a small plate member disposed on an outer surface (+X direction side) of the sidewall 21*s*. The turning shaft 232 is fixed to a first end portion of the coupling section 233. The coupling section 233 extends in parallel to the major axis direction of the cam section 235. A second end portion of the coupling section 233 is disposed closer to the second end portion E2 than the turning shaft 232. The operation section 234 is fixed to an outer surface (in the +X direction) of the second end portion E2 of the coupling section 233.

A groove section 254 extends from a one end portion near the −Y direction and the +Z direction end/corner of the groove forming member 50 to another end portion of the groove forming member 50 in the +Y direction and proximate to a center along the Z direction of the groove forming member 50. That is, the groove section 254 is in the upper half (of the Z direction) of the groove forming member 50.

The opening and closing unit 230 in the second embodiment is configured by the groove section 254 and the opening and closing device 231.

Insertion of the dust box 20 from and the displacement of the lid member 25 from the closed state to the open state are explained.

In FIG. 12, a state in which the dust box 20 is partially inserted into the case main body 41 is illustrated. In a fully taken-out state, the operation section 234 is disposed above (in the +Z direction) the turning shaft 232. The second end portion E2 of the cam section 235 is also disposed above (in the +Z direction) the turning shaft 232. The first end portion E1 of the cam section 235 is disposed below (in the −Z direction) the turning shaft 232. Since the distance from the turning shaft 232 to the second end portion E2 is short, the second end portion E2 does not come into contact with the lid member 25. Therefore, in its removed state, the lid member 25 of the dust box 20 is in the closed state. As the dust box 20 moves in the +Y direction and is inserted into the case main body 41, the operation section 234 enters/engages the groove section 254.

As illustrated in FIG. 13, the operation section 234 moves downward (in the −Z direction) along the groove section 254 according to the installation movement (in the +Y direction) of the dust box 20. At this time, the coupling section 233, the turning shaft 232, and the cam section 235 integrally turn in a +T direction. Consequently, the second end portion E2 of the cam section 235 is displaced to be above (in the +Y direction) the turning shaft 232. The first end portion E1 is displaced below (in the −Y direction) the turning shaft 232.

In FIG. 14, the installed state of the dust box 20 is illustrated. In the fully installed state, the operation section 234 is disposed below (in the −Z direction) the turning shaft 232. The second end portion E2 of the cam section 235 is also disposed below (in the −Z direction) the turning shaft 232. The first end portion E1 is disposed above (in the +Z direction) the turning shaft 232. Since the distance from the turning shaft 232 to the first end portion E1 is long, the first end portion E1 pushes up the lid member 25. Therefore, in the installed state of the dust box 20, the lid member 25 is opened.

In this way, the opening and closing unit 230 displaces the lid member 25 from the closed state to the open state when the dust box 20 is installed.

Removal the dust box 20 and the displacement of the lid member 25 from the open state to the closed state are explained.

As illustrated in FIG. 13, when the dust box 20 is removed from its fully installed state, it moves in the −Y direction, and the operation section 234 moves in the +Z direction along the groove section 254. At this time, the coupling section 233, the turning shaft 232, and the cam section 235 integrally turn in a −T direction. The first end portion E1 of the cam section 235 moves in the −Z direction. The first end portion E1 of the cam section 235 is coupled to the lid member 25 by the string section. The lid member 25 is displaced from the open state to the closed state by the tension of the string section.

In this way, the opening and closing unit 230 displaces the lid member 25 from the open state to the closed state according to the state change of the dust box 20 from the installed state to the removed state.

As explained above, the lid member 25 is mechanically displaced from the closed state to the open state according to the movement of cam section 235 as the dust box 20 installed. Therefore, an electric mechanism is unnecessary to achieve this function. An increase in apparatus cost is prevented.

The lid member 25 in this example embodiment is substantially formed of a conductive material. However, in other examples, only the surface of the lid member 25 may need to be formed of a conductive material.

The lid member 25 in the example embodiment is grounded by coming into contact with the case 40 when in the open state. In other examples, the lid member 25 may be grounded by coming into contact with some other member when in the open state.

The contactor 64 of the housing sensor 60 in some embodiments detects the installed state of the dust box 20 by coming into physical contact with the operation section 34. However, in some examples, the contactor 64 may detect the installed state by coming into contact with some other portion of the dust box 20 besides or in addition to the operation section 34.

According to at least one embodiment explained above, the sheet perforating apparatus 10 includes a static-electricity weakening unit 40E that reduces the static electricity on the punch chips dropped on the lid member 25. Consequently, the sheet perforating apparatus 10 can collect more of the punch chips than would otherwise be the case.

While certain embodiments have been described these embodiments have been presented by way of example only, and are not intended to limit the scope of the present disclosure. Indeed, the novel embodiments described herein may be embodied in a variety of other forms; furthermore, various omissions, substitutions and changes in the form of the embodiments described herein may be made without departing from the spirit of the present disclosure. The accompanying claims and their equivalents are intended to cover such forms or modifications as would fall within the scope and spirit of the present disclosure.

What is claimed is:

1. A sheet perforating apparatus, comprising:

a punch unit configured to punch holes in a sheet from an image processing apparatus;

a dust box below the punch unit and detachably attached to a case;

a lid member attached to the dust box, the lid member being displaceable between a closed state in which the lid member closes an opening of the dust box and an open state in which the lid member does not close the opening of the dust box, the lid member having an inner surface side that faces towards the dust box when in the closed state and faces away from the dust box when in the open state, and when in the open state, the lid member is electrically grounded and directs punch chips that have been dropped from the punch unit towards the opening; and an opening and closing unit configured to displace the lid member from the closed state to the open state when the dust box is inserted into the image forming apparatus and to displace the lid member from the open state to the closed state when the dust box is removed from the image forming apparatus, wherein the opening and closing unit includes:

a groove section formed in the case at an incline with respect to an installation direction for the dust box; and an opening and closing device on the dust box and connected to the lid member, the opening and closing device configured to engage the groove section and move up and down on the dust box according to movement of the dust box along the groove section and displace the lid member from the closed state to the open state or the open state to the closed state when the dust box is inserted or removed from the case.

2. The sheet perforating apparatus according to claim 1, wherein the lid member comprises an electrically conductive material and electrically connects to a conductive connecting section contacting the case when the lid member is in the open state.

3. The sheet perforating apparatus according to claim 1, further comprising:

a static-electricity weakening sheet attached to inner surface side of the lid member to face towards the punch unit when the lid member is in the open state.

4. The sheet perforating apparatus according to claim 1, wherein the opening and closing device includes a push-up member configured to push the lid member open when the dust box is inserted in the case.

5. The sheet perforating apparatus according to claim 1, wherein the opening and closing device includes a cam configured to turn and push the lid member open when the dust box is inserted in the case.

6. The sheet perforating apparatus according to claim 1, wherein the opening and closing device includes a string element configured to pull the lid member closed when the dust box is removed from the case.

7. The sheet perforating apparatus according to claim 1, wherein a first edge portion of the lid member is attached to the dust box and a second edge portion of the lid member displaces upward and downward when the dust box is inserted and removed from the case, and the second end portion is thicker, in a direction orthogonal to a plane including the first and second edge portions, than the first edge portion.

8. The sheet perforating apparatus according to claim 1, wherein the lid member is inclined with respect to the opening when in the open state, and the punch chips that have been dropped from the punch unit contact an inner surface of the lid member when in the open state.

9. The sheet perforating apparatus according to claim 1, wherein the lid member is metal, and the case is electrically grounded.

10. A sheet post-processing apparatus, comprising:

a case that is electrically grounded;

a sheet perforating apparatus in the case and comprising:

a punch unit configured to punch holes in a sheet received from an image processing apparatus;

a dust box below the punch unit and detachably attached to the case;

a lid member attached to the dust box, the lid member being displaceable between a closed state in which the lid member closes an opening of the dust box and an open state in which the lid member does not close the opening of the dust box, the lid member having an inner surface side that faces towards the dust box when in the closed state and faces away from the dust box when in the open state, and when in the open state, the lid member is electrically grounded via an electrical connection to the case and directs punch chips that have been dropped from the punch unit towards the opening; and a groove section formed in the case at an incline with respect to an installation direction for the dust box; and an opening and closing device on the dust box and connected to the lid member, wherein the opening and closing device is configured to engage the groove section and move up and down on the dust box according to movement of the dust box along the groove section and displace the lid member from the closed state to the open state or the open state to the closed state when the dust box is inserted or removed from the case.

11. The sheet post-processing apparatus according to claim 10, further comprising:

an opening and closing unit configured to displace the lid member from the closed state to the open state when the dust box is inserted into the case and to displace the lid member from the open state to the closed state when the dust box is removed from the case.

12. The sheet post-processing apparatus according to claim 10, further comprising:

a string element configured to pull the lid member closed when the dust box is removed from the case.

13. The sheet post-processing apparatus according to claim 10, further comprising:

a static-electricity weakening sheet attached to the lid member to face the punch unit when the lid member is in the open state within the case.

14. The sheet post-processing apparatus according to claim 10, wherein a centerline of the dust box is offset from a centerline of the punch unit when the dust box is installed in the case and the lid member is positioned below the centerline of the punch unit when in the open state.

15. An image processing apparatus, comprising:

a printer unit that outputs a sheet of paper;

a case that is electrically grounded;

a sheet perforating apparatus in the case and including:

a punch unit configured to punch holes in the sheet of paper from the printer unit;

a dust box below the punch unit and detachably attached to the case; and a lid member attached to the dust box, the lid member being displaceable between a closed state in which the lid member closes an opening of the dust box and an open state in which the lid member does not close the opening of the dust box, the lid member having an inner surface side that faces towards the dust box when in the closed state and faces away from the dust box when in the open state, and when in the open state, the lid member is electrically grounded and directs punch chips that have been dropped from the punch unit towards the opening; and a groove section formed in the case at an incline with respect to an installation direction for the dust box; and an opening and closing device on the dust box and connected to the lid member, wherein the opening and closing device is configured to engage the groove section and move up and down on the dust box according to movement of the dust box along the groove section and displace the lid member from the closed state to the open state or the open state to the closed state when the dust box is inserted or removed from the case.

16. The image processing apparatus according to claim 15, further comprising:

a static-electricity weakening sheet attached to the lid member to face the punch unit when the lid member is in the open state within the case.

17. The image processing apparatus according to claim 15, wherein a centerline of the dust box is offset from a centerline of the punch unit when the dust box is installed in the case and the lid member is positioned below the centerline of the punch unit when in the open state.

18. The image forming apparatus according to claim 15, wherein the opening and closing device includes a cam configured to turn and push the lid member open when the dust box is inserted in the case.

19. The image forming apparatus according to claim 15, wherein the opening and closing device includes a string element configured to pull the lid member closed when the dust box is removed from the case.

20. The image forming apparatus according to claim 15, wherein the lid member is inclined with respect to the opening when in the open state, and the punch chips that have been dropped from the punch unit contact an inner surface of the lid member when in the open state.

* * * * *